US005660271A

United States Patent [19]

Castonguay et al.

[11] Patent Number: 5,660,271

[45] Date of Patent: Aug. 26, 1997

[54] OPERATING MECHANISM CRADLE ASSEMBLY FOR HIGH AMPERE-RATED CIRCUIT BREAKERS

[75] Inventors: Roger N. Castonguay, Terryville; David Arnold, Chester; William H. Calder, Plainville, all of Conn.

[73] Assignee: General Electric Company, New York, N.Y.

[21] Appl. No.: 640,644

[22] Filed: May 1, 1996

[51] Int. Cl.[6] ..... H01H 23/00

[52] U.S. Cl. ..... 200/401; 200/400

[58] Field of Search ..... 200/400, 401; 361/94, 49, 115; 335/17, 6, 9, 10; 74/2

[56] References Cited

U.S. PATENT DOCUMENTS 4,001,742 1/1977 Jencks et al. ..... 335/173

4,672,501 6/1987 Bilac et al. ..... 361/96

4,888,458 12/1989 Suzuyoma et al. ..... 200/400

4,968,861 11/1990 Kuhn ..... 200/400

5,424,701 6/1995 Castonguay et al. ..... 335/172

*Primary Examiner*—David J. Walczak

*Attorney, Agent, or Firm*—Richard A. Menelly; Carl B. Horton

[57] ABSTRACT

A high strength operating cradle assembly for an industrial rated circuit breaker operating mechanism wherein the rotational action of the cradle about its pivot is controlled by interconnected operating mechanism links is disclosed. Axial positioning of the cradle on its pivot is maintained by the capture of a positioning track on the cradle pivot within a pair of guide rails on a guide pin extension on the cradle.

10 Claims, 4 Drawing Sheets

42

OPERATING MECHANISM CRADLE ASSEMBLY FOR HIGH AMPERE-RATED CIRCUIT BREAKERS

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts. When the operating mechanism is used within high ampere rated industrial circuit breakers, the operating cradle within the operating mechanism must be capable of motivating corresponding high ampere rated contact arm assemblies for several thousand operations. Since the increased ampere ratings require thermal compliance with regulatory standards as to the size of the electrical contact arms that can be employed, the larger contact arms with higher ampere ratings, increases the associated inertial forces that result from dynamic opening and closing of the circuit breaker contacts. Each component, including the operating cradle, is exposed to higher impact forces. The mechanical components within lower ampere rated circuit breakers could experience fatigue failure when exposed to such impact loading conditions.

Accordingly, one purpose of the invention is to propose an operating cradle assembly that is used with standard circuit breaker operating components to allow such components to experience extended operational life when used within circuit breakers of increased ampere ratings.

SUMMARY OF THE INVENTION

A high strength latching cradle assembly for an industrial rated circuit breaker operating mechanism wherein the rotational action of the cradle about its pivot is controlled by interconnected operating mechanism links. Axial positioning of the cradle on its pivot is maintained by the capture of a positioning track on the cradle pivot within a pair of guide rails on a guide pin extension on the cradle.

DESCRIPTION OF THE PREFERRED EMBODIMENT

Figure 1:
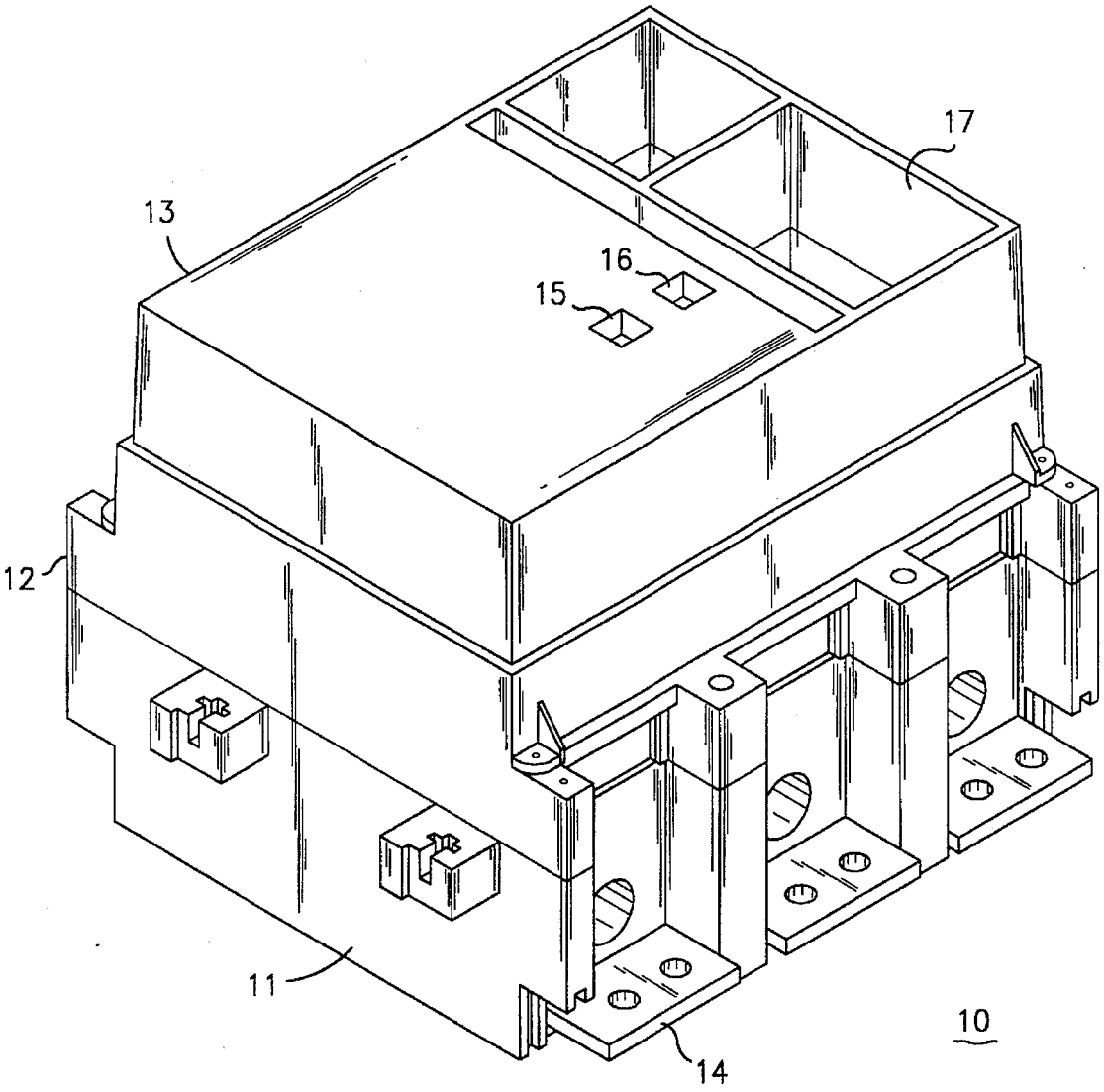
FIG. 1 is a top perspective view of an industrial rated circuit breaker employing the operating mechanism assembly according to the invention.
Figure 2:
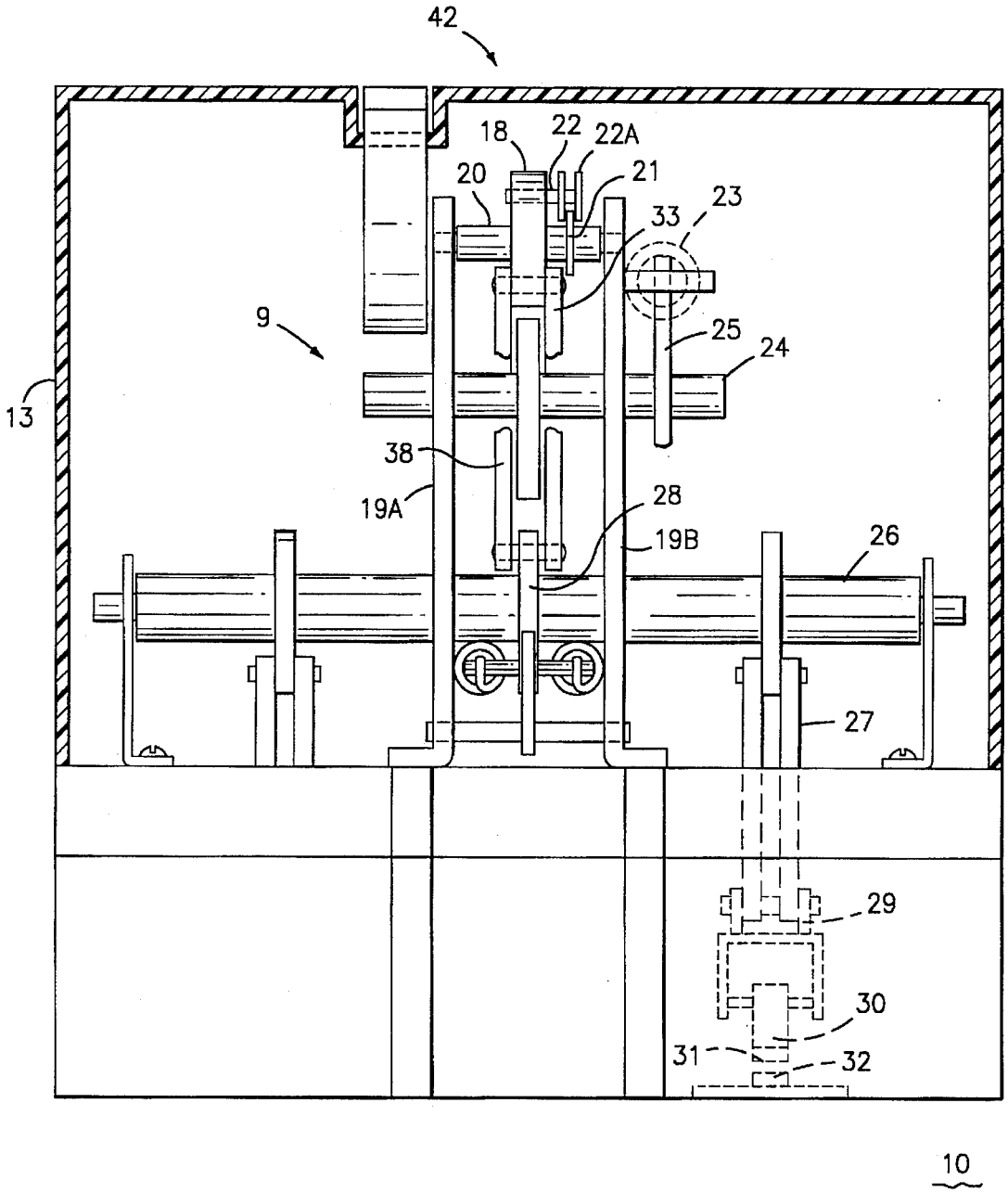
FIG. 2 is an end view of the circuit breaker of FIG. 1 with a portion of the cover removed to depict the circuit breaker operating mechanism.
Figure 3:
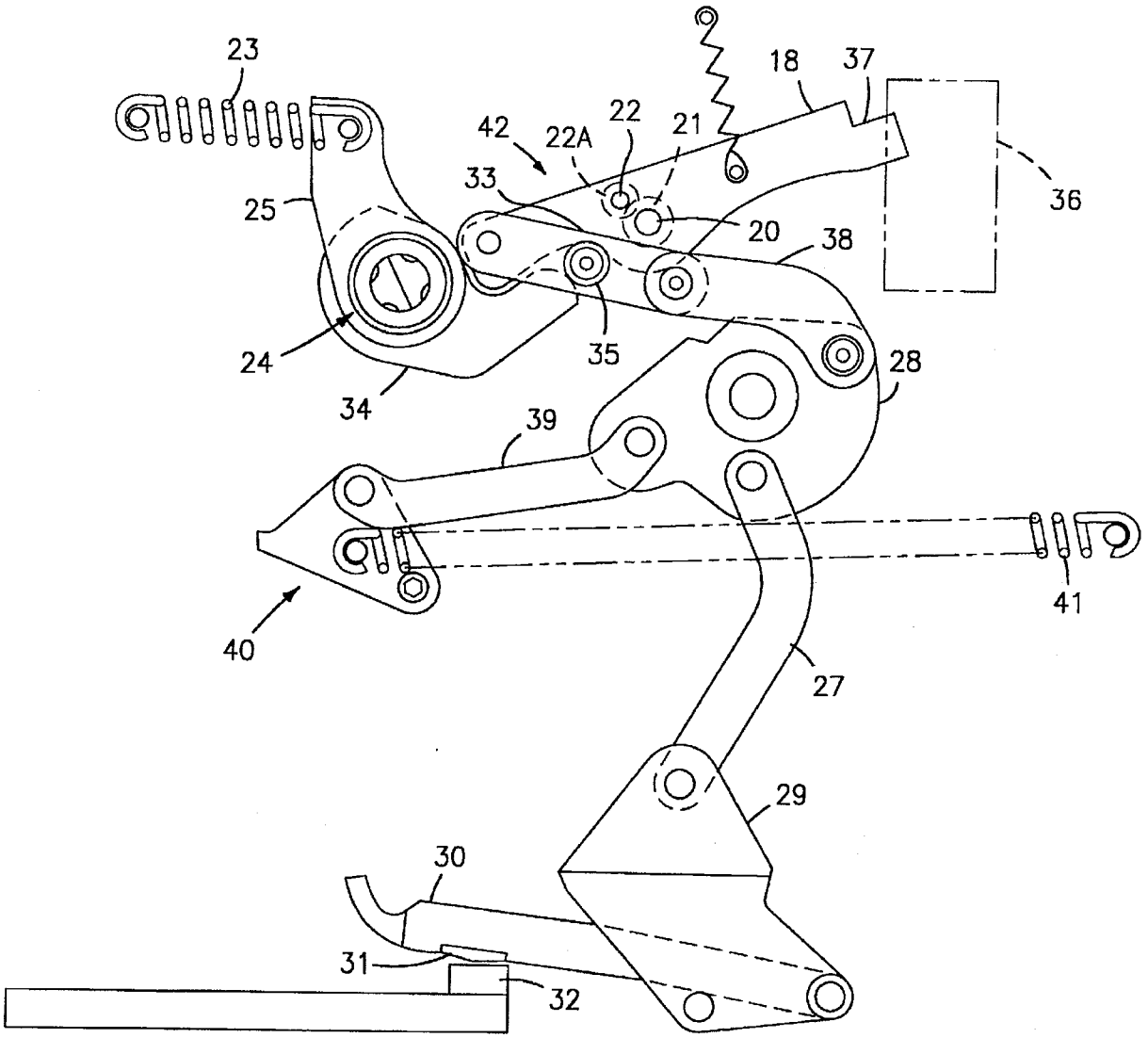
FIG. 3 is an enlarged side view of part of the operating mechanism assembly within the circuit breaker of FIG. 2.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 12 of similar insulative material is attached prior to attaching the top cover 13, also consisting of an electrically-insulative material. Electrical connection with the interior current-carrying components is made by load terminal straps 14 extending from one side of the base and line terminal straps (not shown) extending from the opposite side thereof. The interior components are controlled by an electronic trip unit contained within a recess 17 on the top surface of the top cover 13. Although not shown herein, the trip unit is similar to that described within U.S. Pat. No. 4,672,501 and provides a range of protection and control functions. ON and OFF buttons 15, 16 accessible from the top cover allow manual operation of the circuit breaker operating mechanism 9 to separate the circuit breaker movable and fixed contacts 31, 32 as best seen by now referring to the circuit breaker 10 shown in FIGS. 2 and 3.

The circuit breaker operating mechanism 9 is similar to that described in U.S. Pat. No. 5,424,701 with closing shaft 24 depicted relative to the drive shaft 26 with the various drive and closing springs removed for purposes of clarity and to depict the positional relationship between the two shafts as they interact to control the position of the movable contact arm 30 and the moveable contact 31. The cradle 18 within the cradle assembly 42 rotates about the cradle pivot pin 20 and interacts with both the drive shaft and the closing shafts by means of the cradle upper link 33 and the cradle lower link 38. The cradle is pivotally connected to the operating mechanism frames 19A, 19B by means of the pivot pin 20 and is positionally aligned on the pivot pin 20 by means of a track 21, integrally formed on the pivot pin, and captured within the guide rails 22A integrally formed on the guide pin 22. The pivot pin used with earlier cradle assemblies was grooved to positionally located the cradle during rotation. The provision of the guide pin rails and the pivot pin track is an important feature of the invention in that it provides axial positional control of the cradle pivot, without the stress concentration associated with a grooved pivot pin. This arrangement is capable of withstanding the high inertial loading conditions associated with dynamic opening and closing operations of the operating mechanism when used within circuit breakers having high ampere ratings. The closing spring 23 articulates the closing shaft 24 by means of the closing cam 25. Rotational action is transmitted to the adjacent drive shaft 26 by means of interconnecting upper and lower links 33, 38. Drive link 27 is pivotally attached to the drive cam 28 at one end and with the contact carrier 29 at the other end to drive the contact arm 30 between open and closed positions as defined by the separation or abutment of movable contact 31 to fixed contact 32. Counter-clockwise rotation of the closing shaft drives the cradle upper link 33 into a detente position through interaction of the closing link 34 with the closing pin 35. The cradle 18 is held in position by means of the latch assembly 36 interfacing with the cradle latch surface 37 whereby the latch assembly retains an end of the cradle under quiescent current conditions through the contacts and releases the cradle upon the occurrence of an overcurrent condition through the contacts The cradle lower link 38 interconnects the cradle upper link 33 with the drive cam 28 to articulate both the drive link 27 and the spring link 39. The location of the opening lever 40 relative to the spring link 39 influences the degree of stored energy in the opening spring 41.

Figure 4:
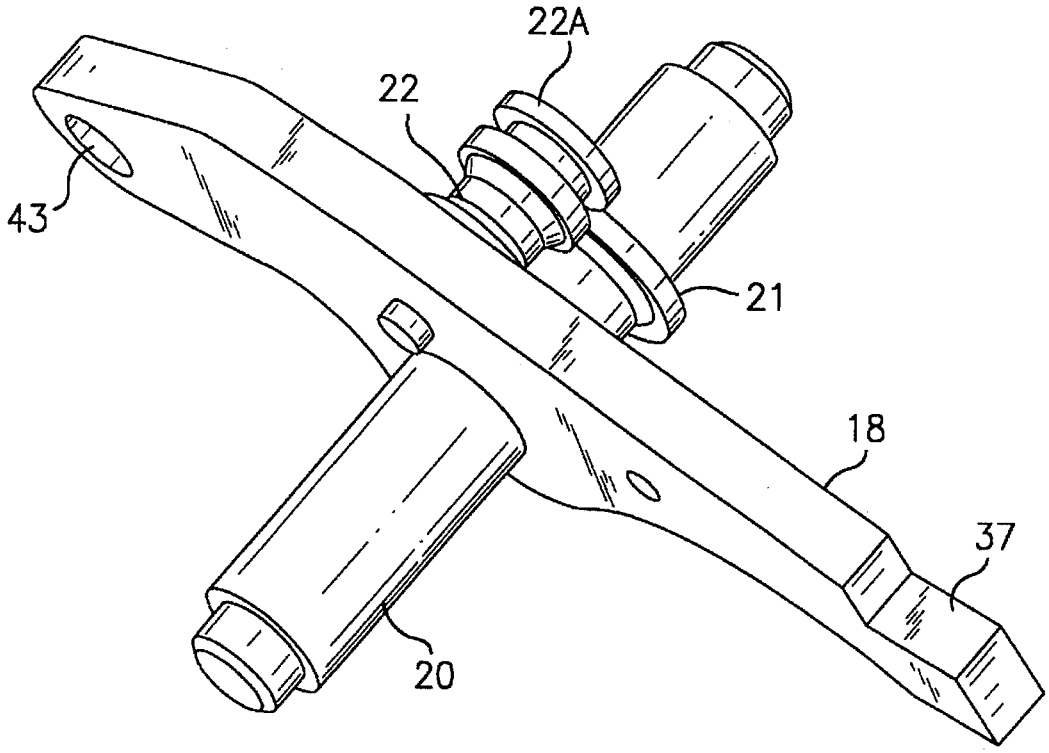
FIG. 4 is an enlarged top perspective view of the operating cradle used with the operating mechanism of FIG. 3.

As best seen in FIG. 4, the cradle assembly 42, in accordance with the invention, comprises a cradle 18 with the cradle latch surface 37 formed at one end. The pivot pin 20 is press-fit within the cradle midway between the cradle latch surface 37 at one end and the aperture 43 for connecting with the upper link 33 of FIG. 3 at the opposite end. The positioning track 21 formed on the pivot pin rotates within the guide rails 22A formed on the additional guide pin 22. Positional alignment of the cradle on the pivot pin is now achieved by the engagement of the positioning track within the rails to substantially reduce the effect of the axial forces generated during cradle rotation under high current interruption on the cradle pivot pin.

A circuit breaker operating mechanism has herein been disclosed having high current-handling capacity and being capable of sustaining high axial forces on the operating mechanism cradle without damage to the cradle or cradle pivot.

We claim:

1. An industrial-rated circuit breaker for high level overcurrent protection comprising:

an insulative base;

a pair of separable contacts within said base, one of said contacts being attached to a movable contact arm;

a contact arm carrier connecting with said movable contact arm and with a contact arm drive link;

an insulative cover above said base, said cover enclosing a closing shaft and a drive shaft, said drive shaft connecting with said contact arm drive link for moving said contact arm carrier and said contact arm between closed and open positions;

an interface cam interacting with said drive shaft for controlling when said drive link moves said contact arm between said open and closed positions;

a cradle, a first end of said cradle connecting with said drive shaft by means of a cradle link, a second end of said cradle interacting with a latch assembly whereby said latch assembly retains said cradle second end under quiescent current conditions through said contacts and releases said cradle second end upon occurrence of an overcurrent condition through said contacts;

a cradle pivot pin supporting said cradle, said pivot pin having positioning means interacting with guide means extending from a side of said cradle for providing additional axial force resistance to said cradle.

2. The industrial-rated circuit breaker of claim 1 wherein said positioning means comprises a track on said cradle pivot pin.

3. The industrial-rated circuit breaker of claim 1 wherein said guide means comprises a pair of rails extending from said cradle.

4. The industrial-rated circuit breaker of claim 2 wherein said track is formed integral with said pivot pin.

5. The industrial-rated circuit breaker of claim 3 further including a guide pin supported on said cradle, said rails being integrally-formed on said guide pin.

6. The industrial-rated circuit breaker of claim 1 wherein said pivot pin is press-fit connected with said cradle.

7. The industrial-rated circuit breaker of claim 1 wherein said pivot pin is positioned intermediate said first and second ends.

8. An industrial-rated circuit breaker for high level overcurrent protection comprising:

an insulative base;

a pair of separable contacts within said base, one of said contacts being attached to a movable contact arm;

an insulative cover above said base, said cover enclosing a drive shaft and a contact carrier, said contact carrier connecting with a contact arm drive link for moving said contact arm carrier and said contact arm between open and closed positions;

an interface cam interacting with said drive shaft for controlling when said drive link moves said contact arm between said open and closed positions;

a cradle, a first end of said cradle connecting with said drive shaft by means of a cradle link and said interface cam another end of said cradle interacting with a latch assembly whereby said latch assembly retains said cradle second end under quiescent current conditions through said contacts and releases said cradle second end upon occurrence of an overcurrent condition through said contacts;

a pair of opposing side frames within said cover;

a cradle pivot pin supporting said cradle and extending between said side frames, said pivot pin including a positioning track perimetric on said pivot pin, said positioning track interacting with guide means extending from said cradle for providing axial force resistance to said cradle.

9. An industrial-rated circuit breaker for high level overcurrent protection comprising:

an insulative base;

a pair of separable contacts within said base, one of said contacts being attached to a movable contact arm;

an insulative cover above said base, said cover enclosing a drive shaft and a contact arm carrier, said contact arm carrier connecting with a contact arm drive link for moving said contact arm carrier and said contact arm between open and closed positions;

an operating mechanism in said cover for moving said contact arm between said open and closed positions;

a cradle, supported by a cradle pivot pin, said cradle interacting with a latch assembly and said operating mechanism whereby said latch assembly retains a cradle end under quiescent current conditions through said contacts and releases said cradle end upon occurrence of an overcurrent condition through said contacts; and a guide pin extending said cradle, said guide pin including rails being integrally-formed and perimetric on said guide pin, said rails capturing a track integrally-formed and perimetric on said pivot pin.

10. An industrial-rated circuit breaker for high level overcurrent protection comprising:

an insulative base;

a pair of separable contacts within said base, one of said contacts being attached to a movable contact arm;

an insulative cover above said base, said cover enclosing a drive shaft and a contact arm carrier, said contact arm carrier connecting with a contact arm drive link for moving said contact arm carrier and said contact arm between open and closed positions;

an operating mechanism in said cover for moving said contact arm between said open and closed positions;

a cradle, supported by a cradle pivot pin ,a surface of said cradle interacting with a latch assembly whereby said latch assembly retains a cradle end under quiescent current conditions through said contacts and releases said cradle end upon occurrence of an overcurrent condition through said contacts;

a pair of opposing side frames within said cover; and a cradle pivot pin supporting said cradle and extending between said side frames, said cradle pivot pin including a positioning track perimetric on said cradle pivot, said positioning track interacting with guide means extending from said cradle for providing axial force resistance to said cradle.

* * * * *